United States Patent [19]

Bergstrom

[11] 4,376,012

[45] Mar. 8, 1983

[54] METHOD OF FORMING A MULTI-PLY WEB FROM PAPER STOCK

[75] Inventor: Jan I. Bergstrom, Beloit, Wis.

[73] Assignee: Beloit Corporation, Beloit, Wis.

[21] Appl. No.: 345,243

[22] Filed: Feb. 3, 1982

Related U.S. Application Data

[60] Continuation-in-part of Ser. No. 195,594, Oct. 9, 1980, abandoned, which is a division of Ser. No. 29,543, Apr. 12, 1979, abandoned.

[51] Int. Cl.[3] ..... D21F 11/00

[52] U.S. Cl. ..... 162/123; 162/212; 162/216

[58] Field of Search ..... 162/341, 343, 344, 347, 162/216, 212, 213, 129, 123, 301, 289, 336, 315, 339, 338

[56] References Cited

U.S. PATENT DOCUMENTS

| | | | |
|---|---|---|---|
| 2,156,445 | 5/1939 | Baxter | 162/339 |
| 2,329,799 | 9/1943 | Thorsen | 162/339 |
| 3,839,143 | 10/1974 | Suckow | 162/123 |
| 3,923,593 | 12/1975 | Verseput | 162/343 |
| 4,021,296 | 5/1977 | Reiner | 162/216 |
| 4,086,130 | 4/1978 | Justus | 162/123 |
| 4,125,429 | 11/1978 | Hergert et al. | 162/344 |
| 4,141,788 | 2/1979 | Justus | 162/343 |

FOREIGN PATENT DOCUMENTS

| | | | |
|---|---|---|---|
| 446331 | 1/1948 | Canada | 162/339 |

*Primary Examiner*—Peter Chin

*Attorney, Agent, or Firm*—Hill, Van Santen, Steadman, Chiara & Simpson

[57] ABSTRACT

A method of forming a multi-ply web by providing upper and lower outer surface plies of low consistency stock on an intermediate high consistency stock layer joined and delivered from a slice chamber for producing a smooth finished web. A stream of high consistency stock is subjected to highly efficient fiber distributing agitation and stabilization in a tortuous path, and then joins the high consistency stock as an intermediate ply layer between the low consistency stock ply layers. The flow of the intermediate ply layer to juncture with the outer ply layers is modulated and smoothed so that the outer ply layers on the intermediate ply layer will present substantially smooth outer surfaces for the multi-ply paper web.

10 Claims, 3 Drawing Figures

METHOD OF FORMING A MULTI-PLY WEB FROM PAPER STOCK

PRIOR APPLICATIONS

This application is a continuation-in-part of Ser. No. 195,594, filed Oct. 9, 1980, now abandoned, which is a division of Ser. No. 029,543, filed Apr. 12, 1979, now abandoned.

BACKGROUND OF THE INVENTION

The present invention relates to improvements in machines and methods for making multi-ply webs from plural supplies of stock each having fibers suspended in a liquid. More particularly, the invention relates to an improved high speed forming arrangement which is particularly well adapted to making multi-ply paper web.

In the formation of multi-ply webs, machines to be competitive must cope with the problems of forming a stronger stiffer finished web having multiple plies and must operate at increasing rates of speed in a manner to either improve the characteristics of the finished web or at least not to detract from the characteristics. To achieve the characteristics of a good multi-ply web, an intermediate layer must be employed which lends increased strength and stiffness, and outer covering plies must be used which cover the intermediate ply and which present an improved smooth surface finish capable of having good appearance and having satisfactory and improved printing qualities.

Technology in paper making has led itself to the formation of multi-ply webs in a single operation wherein the plural plies are simultaneously delivered between opposed travelling forming wires rather than being formed in a layer at a time with the layers laid down on top of each other and bound to each other. A type of multi-ply web forming machine wherein the layers are simultaneously formed is illustrated in U.S. Pat. No. 3,923,593 to Verseput, issued Dec. 2, 1975. This patent illustrates the simultaneous forming of multiple plies with the center ply having a high ash content for improved qualities of strength.

In the instant invention, the problem of the high rate of water drainage which must be encountered is considered, and in accordance with the principles of the present invention, a center ply is formed of a high consistency stock reducing the water drainage which must occur from the intermediate layer through the outer layers. It has been discovered that by utilization of the method in accordance with the present invention, improved machine capacities and speeds are achieved and a higher quality multilayer board is obtained. By using a high consistency stock to form the middle ply, a finished board with greater bending stiffness has been achieved. Furthermore, a heavier higher basis weight board can be formed in a machine with no increase in the water removal capacity. Present commercial methods of forming three-ply board on a twin wire former results in a limitation in basis weight of on the order of 42 pounds per thousand square feet. Using a high consistency stock on the order of 2% to 5%, an increase in basis weight up to 90 pounds per thousand square feet has been obtained. It is also anticipated that bleach board could be made in the range of 33 to 110 pounds per thousand square feet.

One of the difficulties in the formation of multi-ply board with a higher consistency center layer has been the uneven formation and arrangement of fibers in the center board resulting in a bumpy surface on the outer layers and resulting in a less strong and less stiff finished board.

It is an object of the present invention to eliminate the problems of an uneven or bumpy surface board and to increase the overall stiffness of the board by treating the center or intermediate layer of stock in a different manner than the outer finished layers so that an energetic fine scale turbulence is maintained in the outer layers while the thicker inner layer is treated to a controlled turbulence by passing the intermediate layer of stock through a tortuous path of a unique configuration.

It is a further object of the invention to provide a new and improved method for the relatively high speed formation of multiply paper web, and particularly to provide for delivering multiple plies of stock between twin forming wires for continuous reliable improved formation.

Other objects, advantages and features will become more apparent as will equivalent structures and methods which are intended to be covered herein, within the teaching of the principles of the invention in the disclosure of the preferred embodiment in the specification, claims and drawings in which:

FIG. 1 is an enlarged sectional view taken through a multi-ply paper board formed by methods heretofore available;

FIG. 2 is a similar vertical sectional view taken through a portion of paper board formed in accordance with the principles of the present invention; and FIG. 3 is a vertical section taken through a headbox structure constructed and operating in accordance with the method of the present invention.

Figure 2:
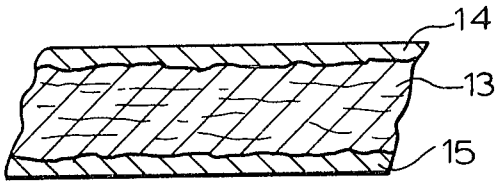
Figure 1:
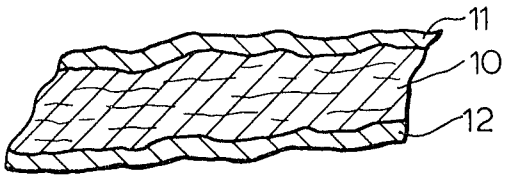
FIG. 1 illustrates an enlarged section of multi-ply paper web formed by processes heretofore available. The center layer was formed from high consistency stock using conventional multi-ply forming methods. This resulted in a top and bottom surface 10 and 12 which were bumpy, much like the surface of small curd cottage cheese. Consequently, when the top and bottom plies were formed to the surfaces 10 and 12, they conformed to the bumpy surface, as illustrated in FIG. 1.

In accordance with the instant invention, the gross depressions and irregularities of the prior center ply are avoided so that even though there may still be slight irregularities they are inconsequential and so shallow that they are filled in by the outer layers and a smooth outer surface is produced as shown in FIG. 2.

The center ply 13 formed from high consistency stock is covered by outer plies 14 and 15 which are formed from relatively lower consistency stock and which are smooth surfaced.

Figure 3:
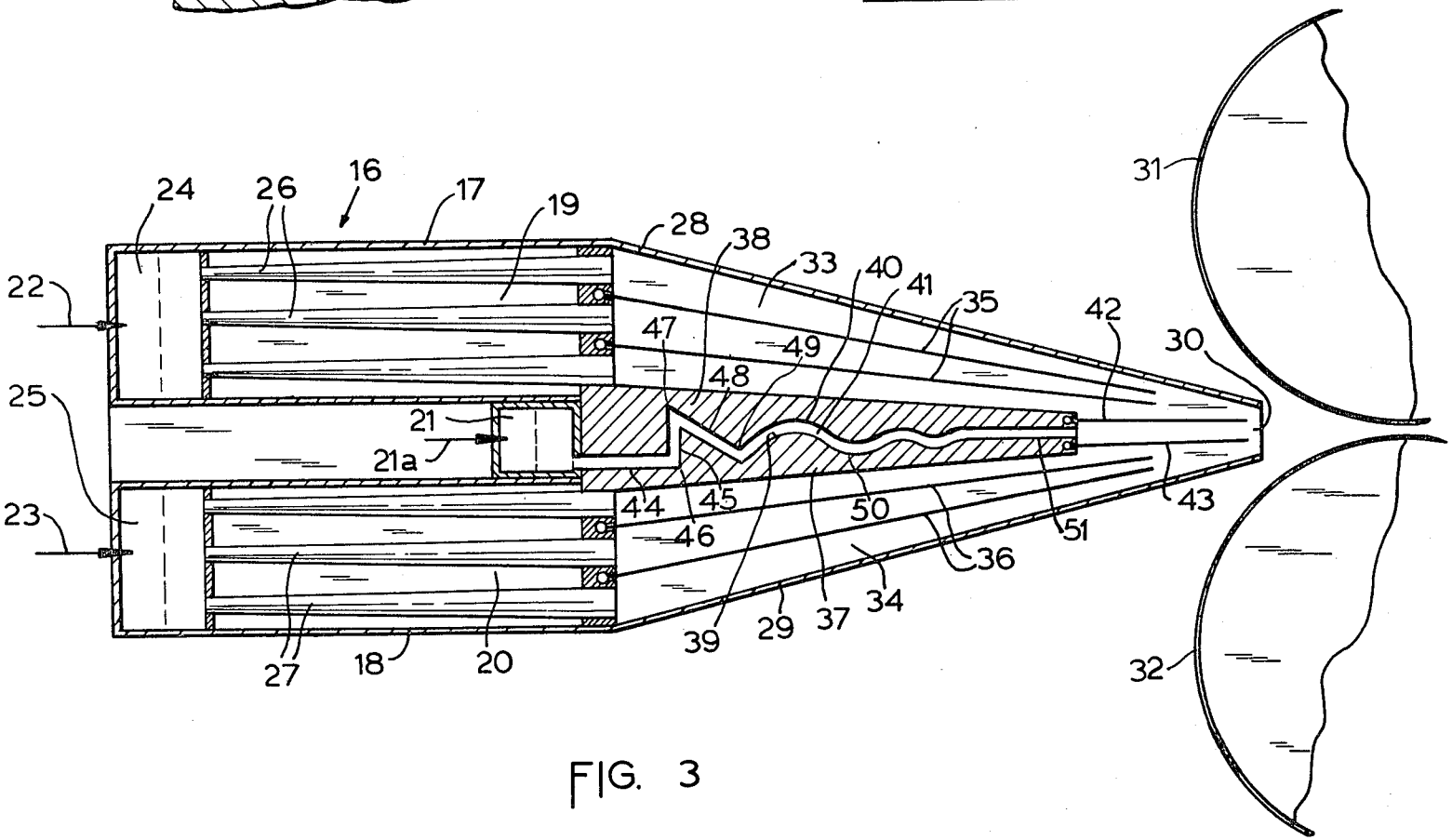

In a headbox 16 as shown in FIG. 3, the structure includes upper and lower closure walls 17 and 18 and opposite closure side walls. The headbox 16 is formed with an upper chamber 19 and a lower chamber 20 for handling the lower consistency stock forming the outer plies 14 and 15. The stock for the intermediate ply 13 is delivered to an intermediate chamber 21 of the headbox. These chambers are as wide as may be required for the width of web to be formed.

Supply lines 22 and 23 for delivering the stock which is to form the outer plies or layers 14 and 15 of the finished web are connected to preferably one end of respective headers 24 and 25 which extend across the width of the headbox and deliver stock to respectively the upper chamber 19 and the lower chamber 20 of the headbox.

Extending through the upper chamber 19 of the headbox in the machine direction of travel are a plurality of tubes 26, and similar tubes 27 extend through the lower chamber 20 of the headbox. These tubes generate and maintain a fine scale turbulence in the stock for outer layers 14 and 15 of the web, delivered by the respective headers 24 and 25.

The headbox 16 delivers to a slice chamber having an upper wall 28 and a lower wall 29. These walls converge from the respective walls 17 and 18 on the headbox so as to control the size of slice opening 30.

Stock for the upper outer layer 14 will travel in a downstream direction through upper portion 33 of the slice chamber. Stock for the lower outer layer 15 will travel through lower chamber portion 34 of the slice chamber.

Positioned in each of the upper and lower portions 33 and 34, respectively, of the slice chamber are fine turbulence inducing means comprising a plurality, herein sets of two in each instance, of downstreamwardly extending trailing flexible elements 35 and 36, respectively, which are preferably sheet-like in form, but which may take different forms such as trailing individual finger-like elements which are divided across the width of the headbox. The trailing sheet-like elements 35 and 36 are anchored at their upstream ends, and their downstream trailing ends free floating or freely positionable. This aids in maintaining the fine scale turbulence which is induced in the relatively low consistency stock and insures even distribution of fibers and elimination of flocculation, which is particularly necessary for being able to apply a fine thin layer of paper efficiently to each of the outer surfaces of the intermediate layer 13 to form a multilayered web. Preferably, the elements 35 and 36 terminate a substantial distance upstream from the slice opening 30.

The multilayered stock web is delivered between dewatering forming surface means illustrated fragmentally by the travelling forming wires 31 and 32.

Centrally located in the slice chamber is a rigid structure providing a separate path for the high consistency stock for the intermediate layer 13 of the web. The structure for controlling the intermediate layer has an upper wall 38 and a lower wall 37 with the walls being rigid. These walls may comprise respective complementary plates, and the lower plate 37 having a surface 39 which faces upwardly toward and cooperates with a complementary downwardly facing surface 40 on the upper plate 38 to define an undulating tortuous path 41 between them and through which the high consistency stock flows on its way from its header 21 supplied with stock delivered by a delivery line 21*a*. The high consistency stock flows through the tortuous path 41 formed between the upper surface 40 and lower surface 39 of the plates 38 and 37. At the downstream ends of the rigid walls are means comprising flexible projecting lips 42 and 43 desirably having their free ends terminating short of the slice opening 30, and which guide the high consistency stock layer to the slice opening. At the slice opening 30, the outer layers of low consistency stock from the chamber portions 33 and 34 are laid smoothly on the intermediate high consistency layer from the path 41, and the combined layers flow between the forming surfaces 31 and 32 to form the multiply web of FIG. 2.

The tortuous path 41 for the high consistency stock is desirably of substantially uniform depth from the headbox to the downstream end of the rigid intermediate portion provided by the plates 37 and 38 and may take modified forms from that shown, but the path is arranged to begin with relatively vigorous turbulency inducing path deviations and to continue on for the remainder of travel, although with less turbulent violence to where the intermediate layer of stock is discharged to flow between the forming surfaces.

In a desirable arrangement as shown in FIG. 3, for the practice of the method of the present invention, the path 41 extends throughout the width of the slice chamber to match the chamber portions 33 and 34. In the upstream portion of the path 41, the high consistency stock is directed through a substantially straight-on lead-in section 44 extending downstream from the headbox intermediate chamber 21. From the downstream end of the section 44 the stock is driven through relatively vigorous path deviations provided, at least in part, by a straight jog section 45 of limited length which extends substantially right angularly relative to the machine axis of the slice chamber and into which the high consistency fibrous stock is directed turbulently against the wall of the section 45 which joins the downstream end of the section 44 at an abrupt right angular juncture 46.

From the downstream end of the jog section 45 the high consistency fibrous stock is driven turbulently through an abrupt, acute angle turn 47 into a generally reversely extending but downstreamwardly obliquely slanting straight section 48 of substantial length. Turbulence in the turn 47 is enhanced by some pressure drop as the direction of travel of the high consisting stock is abruptly changed. From the downstream end of the section 48 the high consistency fibrous stock is driven through an abrupt obtuse angle turn juncture 49 into the upstream end of and then through a sinuous path section 50, and caused to travel through a succession of smoothly curved sinuous undulations or loops in such section which progressively diminish in length and height as the section 50 progresses downstream to a substantial length straight-on terminal section 51 through which the stock is conducted to the end of the path 41. At least in the sections 50 and 51, the path 41 is desirably of substantially uniform depth. Therefore, as the high consistency stock stream is caused to flow through the fiber distributing flow path 41, the stock stream is initially vigorously agitated in a manner to thoroughly and substantially uniformly distribute the fibers throughout the stream, and such distribution with substantial freedom from agglomeration is then maintained in stabilized fashion as the stream continues to the downstream end of the path 41.

As may be further noted in FIG. 3, the downstream ends of the rigid walls 37 and 38, and thus the downstream end of the path 41 therebetween, terminate a substantial distance upstream from the slice opening 30. The flexible lips 42 and 43 define a flexible elongate pressure-drop-containing straighton extension of the path 41 to the slice opening 30 where the low consistency stock outer layers are caused to join the high consistency stock intermediate layer. The lips 42 and 43 provide in cooperation with the straight section 51 means for causing a modulating and smoothing and stabilization of the flow of the intermediate ply layer provided by the high consistency fibrous stock to juncture with the outer ply layers provided by the low consistency stock, so that the outer ply layers engaged on the intermediate ply layer will present substantially smooth outer surfaces for the multi-ply paper web. As will be apparent, to attain the desired smooth outer surface results, the low consistency stock layer streams and the high consistency stock layer intermediate stream must be controlled to flow together at a desired, stable velocity to the forming surface means 31 and 32. In keeping with the function of the flexible lips 42 and 43, they may be spaced apart slightly greater than the depth of the discharge end of the path 41, and they may extend substantially parallel to one another when the stock pressure is substantially equal on both sides of each of the flexible lips. It may also be noted that by having the free ends of the fine turbulence elements 35 and 36 terminated a substantial distance upstream from the free ends of the lips 42 and 43, the outer low consistency stock layers will join the intermediate high consistency stock layer smoothly and without turbulence just inside the slice opening 30, to the attainment of the desirable smooth surface relationship of FIG. 2.

Any preferred system may be employed for controlling the stock layer streams through the slice chamber portions. One such system is disclosed in Justus U.S. Pat. No. 4,086,130.

The stock for the center ply, which is delivered to and through the intermediate path 41, is high consistency on the order of being in the range of 1% to 5%, and preferably is different from that for the outer plies and may include long fiber kraft, hardwood fibers and reclaimed mechanical fibers.

In summary, a high consistency stock is delivered through a forced undulating or tortuous path between the flow of the outer layers. The joined outer and intermediate layers are simultaneously delivered through the delivery end of the nip between travelling forming surfaces. A high consistency of the intermediate layer reduces the amount of drainage which must occur through the outer layers and, of course, this results in much less disturbance of the fiber arrangement for the outer layers and results in improved outer layer formation. The reduced moisture flow also helps improve the arrangement of fibers for the intermediate layer and thereby improves the stiffness and quality of the multi-ply web.

The turbulence induced in the central, intermediate ply stock, and in the outer layers, upstream from their joining, results in thorough deflocced, substantially uniformly distributed stock fibers in all of the layers. While the higher consistency intermediate layer as formed may not be perfectly smooth at its outer surfaces, any uneveness are so minor that the outer layers readily fill any slight depressions, and in the finished sheet it's outer surfaces are smooth, as shown in FIG. 2.

It will be understood that variations and modifications may be effected without departing from the spirit and scope of the novel concepts of this invention.

I claim as my invention:

1. A method of making high strength smooth surfaced paper from stock having a slurry of fibers in a liquid carrier, comprising:

delivering high consistency fibrous stock to the upstream end of a rigid stock flow passageway of substantially uniform depth throughout its length communicating at its downstream end through a slice with paper web forming surface means, and in said passageway:

a. driving the stock from a straight-on upstream machine direction axis section through an abrupt right angular juncture into and then through an elongated straight jog section which extends substantially right angularly relative to the machine direction axis of the slice chamber, b. from said jog section driving the stock through an abrupt turn acute angle juncture with some pressure drop, and then downstreamwardly through an elongated straight slanting passageway section to and through an abrupt turn obtuse angle juncture into a sinuous passageway section, and therein c. driving the stock through a plurality of smoothly curving sinuous loops which diminish progressively in length and height in a downstream direction d. and from the downstream end of said sinuous section conducting the stock through a straight-on downstream stabilizing terminal section of substantial length to the downstream end of said passageway;

and in said jog and slanting sections and said abrupt juncture vigorously agitating the stock and effecting substantially uniform distribution of the fibers in the stock, and maintaining such distribution throughout the sinuous and straight-on terminal sections to the downstream end of said passageway, while modulating and smoothing of the stock in said terminal section.

2. A method according to claim 1, which comprises controlling pressure drop of the stock at said downstream end of said passageway.

3. A method according to claim 2, which comprises effecting said pressure drop between flexible lips which extend downstream from said downstream end of said passageway and are spaced apart greater than the depth of said passageway.

4. A method of forming a multi-ply smooth surfaced paper web from stocks having a slurry of fibers in a liquid carrier, comprising the steps of:

delivering from respective upper and lower slice chamber portions low consistency fibrous stock to a slice opening for providing upper and lower outer surface ply layers for a finished web;

maintaining fine scale fiber distributing turbulence in the low consistency stock in said upper and lower slice chamber portions;

delivering and driving a stream of high consistency fibrous stock into the upstream end of, and then through, a path in a rigid intermediate portion of the slice chamber having its downstream end adjacent to said slice opening;

in an upstream part of said path turning said stream from a straight-on section abruptly through a right angular juncture into a substantially right angular elongated straight jog section, then turning the stream abruptly at an acute angle from the downstream end of said jog section into the upstream end of a downstreamwardly elongated straight slanting section of substantial length, and from the downstream end of said slanting section abruptly at an obtuse angle turning the stream into the upstream end of a sinuous section extending downstream from said slanting section, and in said jog and slanting sections and said abrupt junctures subjecting said high consistency stock to vigorous fiber distributing agitation and attaining thorough and substantially uniform distribution of fibers in the stream;

in said sinuous section driving the high consistency stock through a plurality of smoothly curving sinuous loops which diminish progressively in length and height in a downstream direction and thereby maintaining said uniform fiber distribution;

modulating and smoothing flow of said stream in a straighton downstream terminal section of said path;

discharging said modulated and smooth high consistency stock stream from the downstream end of said terminal section and joining as an intermediate ply layer between said low consistency outer ply layers;

and causing said outer ply layers to form on said intermediate ply layer smooth outer surfaces for the multiply paper web.

5. A method according to claim 4, which comprises, as a part of said modulating and smoothing, controlling pressure drop of said high consistency stock intermediate ply layer at the discharge end of said terminal section of said path.

6. A method according to claim 4, which comprises maintaining fine scale turbulence in at least one of said upper and lower slice chamber portions by operating flexible sheet members secured at their upstream ends at the upstream end of said slice chamber and having their downstream ends unattached and spaced upstream from the slice opening.

7. A method according to claim 4, which comprises in said rigid intermediate portion of the slice chamber maintaining the stream of high consistency stock in a substantially uniform depth from the upstream to the downstream end of the rigid portion.

8. A method according to claim 4, which comprises effecting said modulating and smoothing at least in part by receiving said high consistency stock stream between flexible lips which extend downstream from the downstream end of said rigid intermediate portion of the slice chamber and are spaced apart greater than the depth of said terminal section, and effecting a pressure drop of the stock stream between said lips.

9. A method according to claim 4, comprising effecting the discharge of the modulated and smooth high consistency stock stream from the downstream end of said terminal section into an elongate pressure drop extension of said downstream section between flexible projecting lips extending to said slice opening.

10. A method according to claim 9, which comprises maintaining said fine scale fiber distributing turbulence of the low consistency stock in said upper and lower slice chamber portions by driving the low consistency stock along trailing elements anchored at their upstream ends and with their downstream trailing ends free floating and located substantially upstream from the free ends of said lips, and joining said outer ply layers to said intermediate ply layer adjacently upstream from said slice opening.

* * * * *